US009856660B2

(12) United States Patent
Yin et al.

(10) Patent No.: US 9,856,660 B2
(45) Date of Patent: Jan. 2, 2018

(54) HOME PLATE CONNECTING DEVICE

(71) Applicants: Jihong Yin, Shandong (CN); Yongkang Zhao, Shandong (CN); Xiaochen Hu, Qingdao Shandong (CN); Yunqi Zhao, Qingdao Shandong (CN)

(72) Inventors: Jihong Yin, Shandong (CN); Yongkang Zhao, Shandong (CN); Xiaochen Hu, Qingdao Shandong (CN); Yunqi Zhao, Qingdao Shandong (CN)

( * ) Notice: Subject to any disclaimer, the term of this patent is extended or adjusted under 35 U.S.C. 154(b) by 0 days.

(21) Appl. No.: 15/011,583

(22) Filed: Jan. 31, 2016

(65) Prior Publication Data

US 2017/0191275 A1 Jul. 6, 2017

(30) Foreign Application Priority Data

Jan. 6, 2016 (CN) ..... 2016 2 0008175 U

(51) Int. Cl.

| | |
|---|---|
| ***E04F 19/06*** | (2006.01) |
| ***E06B 3/30*** | (2006.01) |
| ***E04F 13/00*** | (2006.01) |
| ***E04F 15/00*** | (2006.01) |

(52) U.S. Cl.

CPC ..... *E04F 19/061* (2013.01); *E04F 13/00* (2013.01); *E04F 15/00* (2013.01); *E06B 3/301* (2013.01)

(58) Field of Classification Search

CPC ..... E06B 1/62; E06B 1/34; E06B 1/52; E06B 1/02; E06B 1/32; E06B 1/18; E06B 1/08; E06B 3/301; E04F 19/061; E04F 15/00; E04F 13/00

USPC ..... 52/204.2, 205, 207, 210, 211, 212, 213, 52/215, 311.1

See application file for complete search history.

(56) References Cited

U.S. PATENT DOCUMENTS

| | | | | |
|---|---|---|---|---|
| 3,711,995 A * | 1/1973 | Anderson | E06B 1/32 | 49/504 |
| 4,084,361 A * | 4/1978 | Aspaas | E05D 1/04 | 49/501 |
| 4,237,665 A * | 12/1980 | Molyneux | E06B 1/003 | 49/504 |
| 4,344,254 A * | 8/1982 | Varlonga | E06B 3/308 | 49/401 |

(Continued)

*Primary Examiner* — Brian Glessner
*Assistant Examiner* — Adam Barlow

(57) ABSTRACT

The invention relates to the field of home decoration, in particular to a home plate connecting device, which includes a plate and plate connecting piece, a glass and plate connecting piece, a plate bottom edge and ground connecting piece, a decorative plate and plate connecting piece, a doorframe and wall connecting piece and a plate chamfer connecting piece, wherein each of the connecting pieces is provided with a rubber barbed tenon structure and a mortise structure with a barbed accommodation groove. According to the invention, the mortise and tenon structures and a threaded connection manner are adopted for fixation, so that the device can be freely dismounted and conveniently packaged and transported; each part is matched, and is easy to position, so that mounting and dismounting working efficiency is improved; and the dismounted parts are prevented from damage, and are high in reutilization rate, so that the device can be widely applied to the field of home mounting and decoration.

4 Claims, 23 Drawing Sheets

(56) References Cited

U.S. PATENT DOCUMENTS

| | | | | | |
|---|---|---|---|---|---|
| 4,676,026 | A * | 6/1987 | Schreiner | E06B 1/02 | 49/401 |
| 4,856,239 | A * | 8/1989 | Elsasser | E06B 1/30 | 52/100 |
| 4,907,391 | A * | 3/1990 | Over | E06B 1/6007 | 52/204.593 |
| 4,944,118 | A * | 7/1990 | Biro | E06B 3/44 | 49/504 |
| 4,991,369 | A * | 2/1991 | Lamb | E06B 3/303 | 49/463 |
| 5,289,659 | A * | 3/1994 | Harrison | E06B 1/02 | 49/501 |
| 5,412,922 | A * | 5/1995 | Vittori | E04G 23/02 | 49/380 |
| 5,555,682 | A * | 9/1996 | Colitto | E06B 1/62 | 52/100 |
| 6,298,614 | B1 * | 10/2001 | Fisher | E04F 13/0864 | 52/100 |
| 8,857,107 | B1 * | 10/2014 | Key | E06B 1/70 | 49/460 |
| 2003/0126812 | A1 * | 7/2003 | Folsom | E06B 1/345 | 52/204.62 |
| 2006/0107608 | A1 * | 5/2006 | Mirau | E06B 1/08 | 52/211 |
| 2007/0028539 | A1 * | 2/2007 | Peabody | E06B 1/34 | 52/204.55 |
| 2008/0086961 | A1 * | 4/2008 | Westermann | E06B 3/221 | 52/204.593 |
| 2010/0263307 | A1 * | 10/2010 | Gilles | E06B 1/68 | 52/213 |
| 2010/0293881 | A1 * | 11/2010 | Betz | E06B 3/301 | 52/656.2 |

* cited by examiner

HOME PLATE CONNECTING DEVICE

TECHNICAL FIELD OF THE INVENTION

The invention relates to the field of home decoration, in particular to a home plate connecting device.

BACKGROUND OF THE INVENTION

Connection of plates, connection of plates and other materials and connection of plates and walls are usually required in the field of home mounting and decoration. In an existing construction mounting process, a glue adhesion manner or bolts and screws are usually adopted, which may easily cause inconvenience in dismounting and mounting, high manpower and material resource consumption and delay of the whole engineering construction progress in the mounting process; and adoption of an integrated structure may easily cause difficulty in transportation and storage.

From the above, there is an urgent need for a home plate connecting device which can be freely dismounted, conveniently transported and stored and easily mounted and is free of once moulding in the field of home decoration and particularly the field of home plates.

SUMMARY OF THE INVENTION

The technical problem to be solved by the invention is how to overcome the shortcomings of the prior art and to provide a home plate connecting device, which can be freely dismounted, conveniently transported and stored and easily mounted and is free of once moulding.

In order to achieve the purpose, the technical solution adopted by the invention is implemented as follows:

a home plate connecting device is provided, which includes a plate and plate connecting piece, a glass (screen) and plate connecting piece, a plate bottom edge and ground connecting piece, a decorative plate and plate connecting piece, a doorframe and wall connecting piece and a plate chamfer connecting piece;

the plate and plate connecting piece includes an upright post, a U-shaped corner connector and end connecting pieces, each of the two end connecting pieces is connected with a plate through screws, and is provided with two hairy fibre rods which face the outer side, the two end connecting pieces are connected with the two sides of the U-shaped corner connector through buckling openings, the U-shaped corner connector includes a U-shaped corner connector with rubber barbed tenon structures on the two sides and a U-shaped corner connector with barbed accommodation groove mortise structures on the two sides, the corner connectors of the two structures are connected through the mortise and tenon structures, and the two sides are connected with a wooden decoration strip through the mortise and tenon structures formed by the rubber barbed tenon structures and the barbed accommodation groove mortise structures respectively after the corner connectors are connected;

the glass and plate connecting piece includes a master glass pressure holder frame and a glass pressure sub holder frame, the master glass pressure holder frame is provided with a mortise structure with a barbed accommodation groove, and is fixed at one end of the plate through screws, the glass pressure sub holder frame with a rubber barbed tenon structure is connected with the fixed master glass pressure holder frame through the mortise and tenon structures after glass is pressed into the master glass pressure holder frame, then a section of the whole structure is trapezoidal, and elastic parts capable of closely clamping the glass are arranged on the two sides of a sunken part in a part above the narrow part;

the plate bottom edge and ground connecting piece includes a pressure trim, a lower door stop frame and a corner connector connecting piece, the corner connector connecting piece is connected with the ground or a door casing through screw structures, the pressure frame is fixed on the corner connector connecting piece through screws and bolts, and the corner connector connecting piece is provided with a rubber barbed tenon structure, and can be connected with the lower door stop fame with a mortise structure with a barbed accommodation groove through the mortise and tenon structures;

the doorframe and wall connecting piece includes a cushion block, a large door side casing frame, a small door side casing frame, E-shaped buckles and wooden decoration strips, the cushion block is connected to a wall body through screws, the large door side casing frame is connected with the wall body and the cushion block through screws, and is connected with a door casing plate through screws, the small door side casing frame is connected with the door side casing plate through buckles and screw structures, and is fixed on the inner side of the wall body through the screw structures, the large door side casing and the small door side casing frame are provided with grooves into which the E-shaped buckles can be embedded, and the wooden decoration strips are fixed on the outer side of the large door side casing frame and the outer side of the small door side casing frame, through the embedded E-shaped buckles;

the decoration plate and plate connecting piece includes two sections of connecting rods with rubber barbed tenon structures and a mortise connecting piece with a barbed accommodation groove, a contact part of each of a decoration plate and the plate is provided with a mortise, and connection can be finished by arranging the mortise connecting piece with the barbed accommodation groove in the mortises of the plate and the decoration plate respectively, arranging the two ends of the connecting sections with the rubber barbed tenon structures in the mortise connecting piece with the barbed accommodation groove in the plate and the decoration plate respectively and performing pressing;

the plate chamfer connecting piece includes a Y-shaped part with a barbed accommodation groove mortise structure and a T-shaped part with a rubber barbed tenon structure, the Y-shaped part is fixed on the cuter side of a wall corner through screw structures, the plate is inwards pushed along the two side edges of the Y-shaped part, the rubber barbed tenon structure of the T-shaped part is pressed into the mortise structure of the T-shaped part, and a T-shaped guard plate is attached to the outer side of the plate on the two sides of the Y-shaped part for fixation;

the plate corner connecting piece includes a part with a barbed accommodation groove mortise structure and a part with a rubber barbed tenon structure, and a spring part may be additionally arranged under the condition that the parts are required to be pressed;

furthermore, the lower door stop frame of the plate bottom edge and ground connecting piece may be connected with a slope-shaped water preventing part through screws and buckle structures;

furthermore, rubber anti-collision parts are arranged on parts, contacting with a wall surface, of the large and small door side casino frames, of the doorframe and wall connecting piece; and furthermore, each connecting piece may be made from aluminium, plastic steel or wood.

The invention has the advantages that the shortcomings of the prior art are overcome, and the provided home plate connecting device can be freely dismounted, conveniently transported and stored and easily mounted, and is free of once moulding.

DESCRIPTION OF THE DRAWINGS

FIG. 2A shows the parts connect with plate and double-pen glass together.

Figure 1:
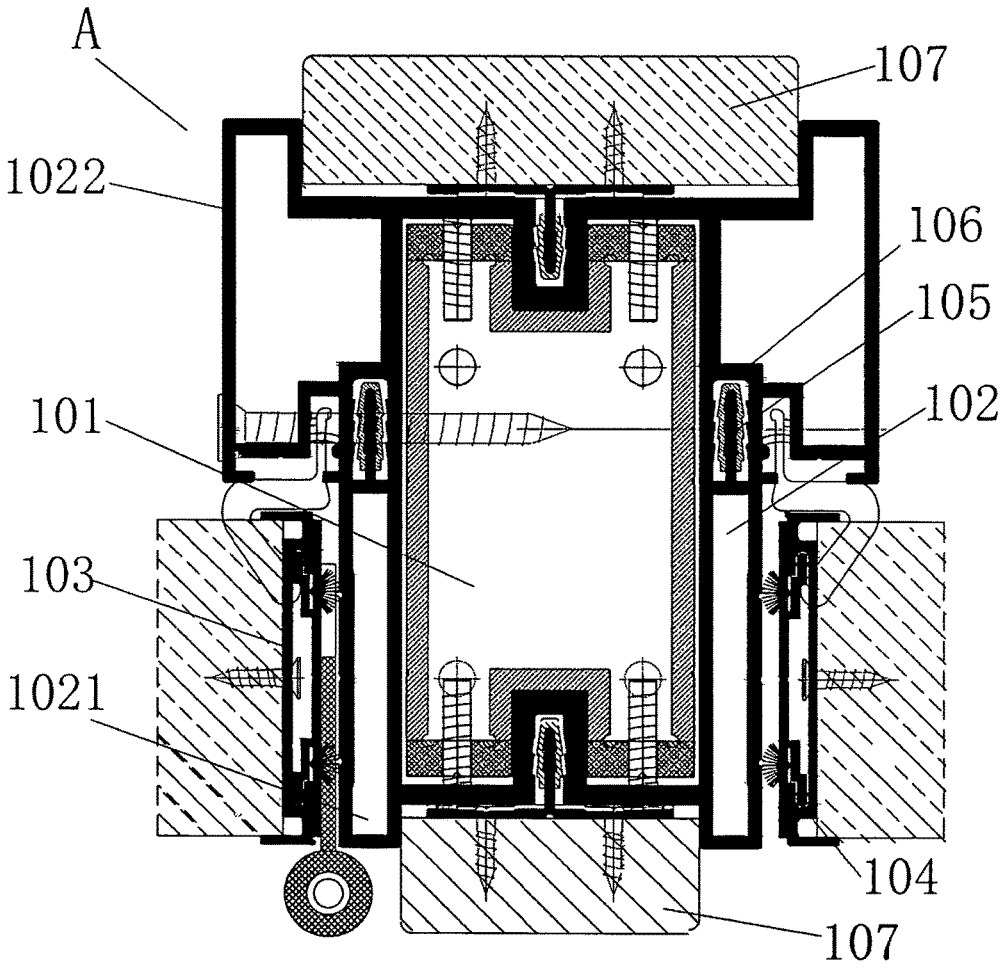
FIG. 1 is a structure diagram of a plate and plate connecting piece according to the invention.
Figure 2A:
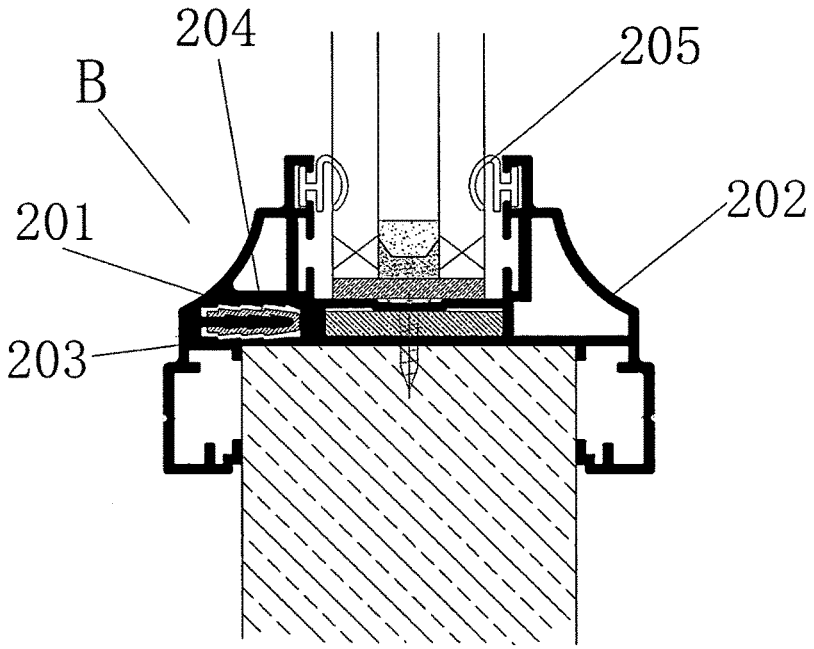
FIG. 2A is structure diagram of a glass and plate connecting piece according to the invention.
Figure 2B:
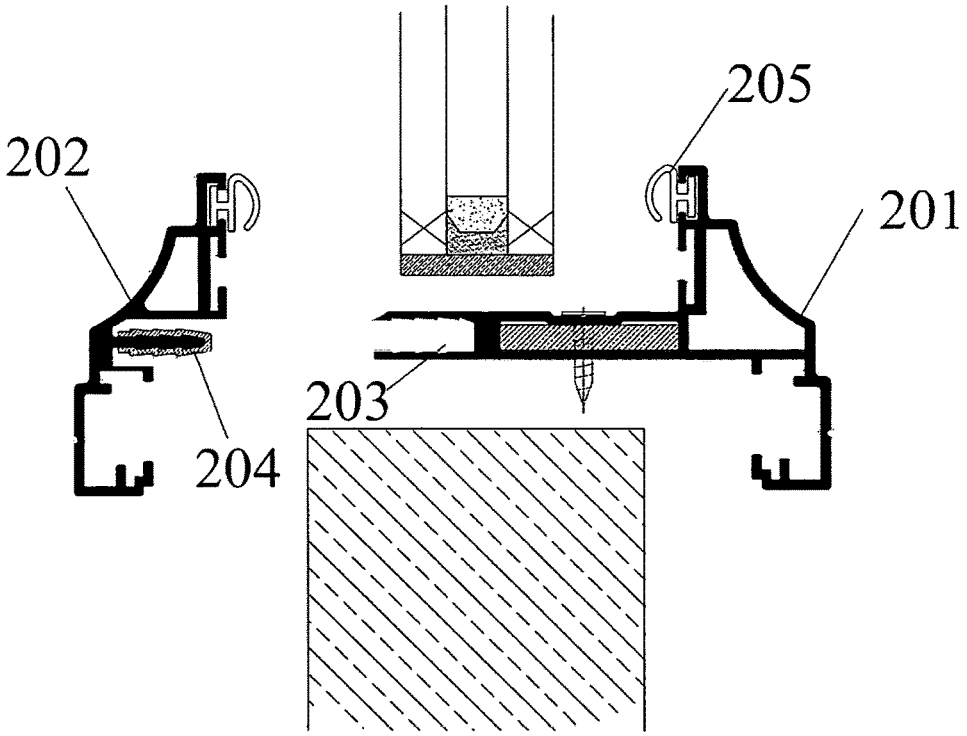
FIG. 2B shows the separation of each parts.
Figure 3:
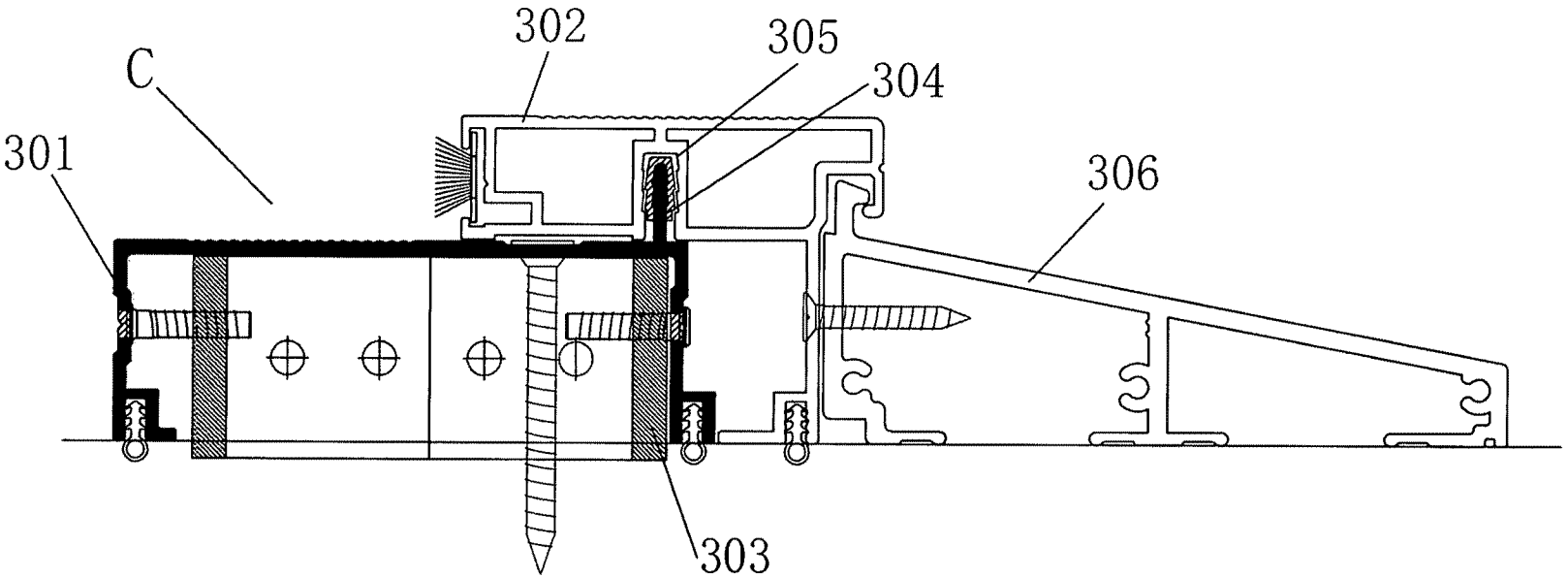
FIG. 3 is a structure diagram of a plate bottom edge and ground connecting piece according to the invention.
Figure 4:
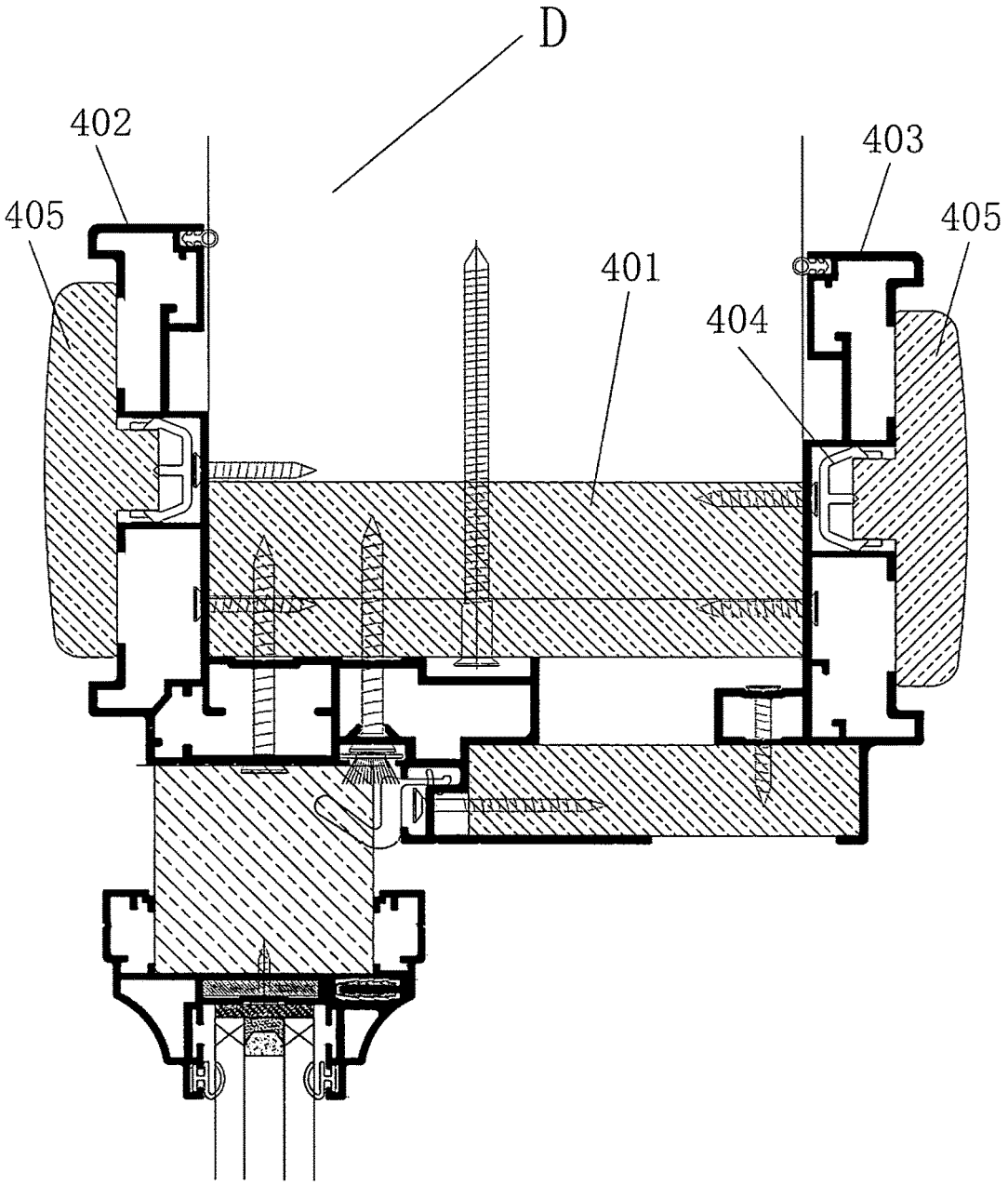
FIG. 4 is a structure diagram of a doorframe and wall connecting piece according to the invention.
Figure 5:
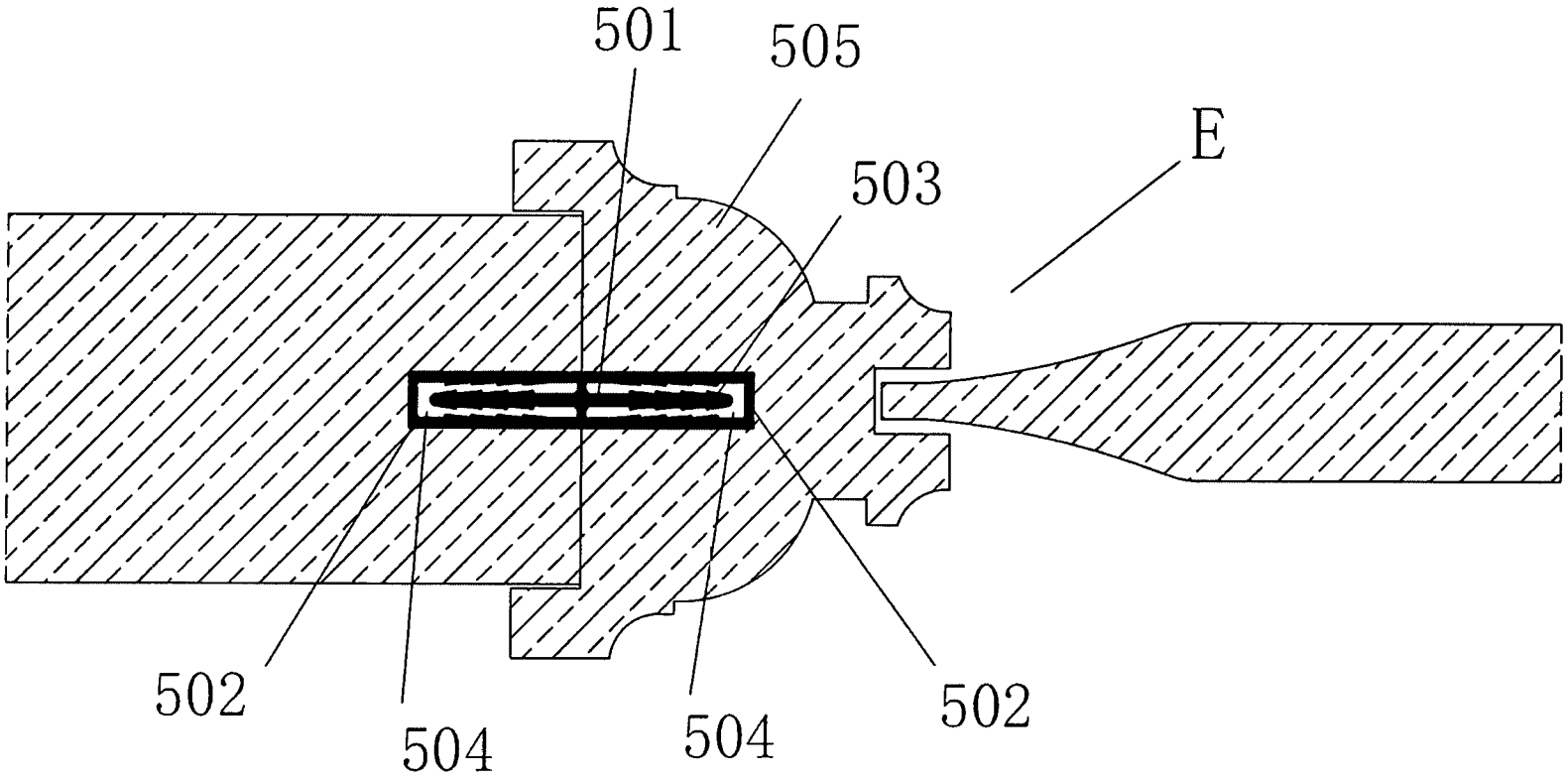
FIG. 5 is a structure diagram of a decoration plate and plate connecting piece according to the invention.
Figure 6:
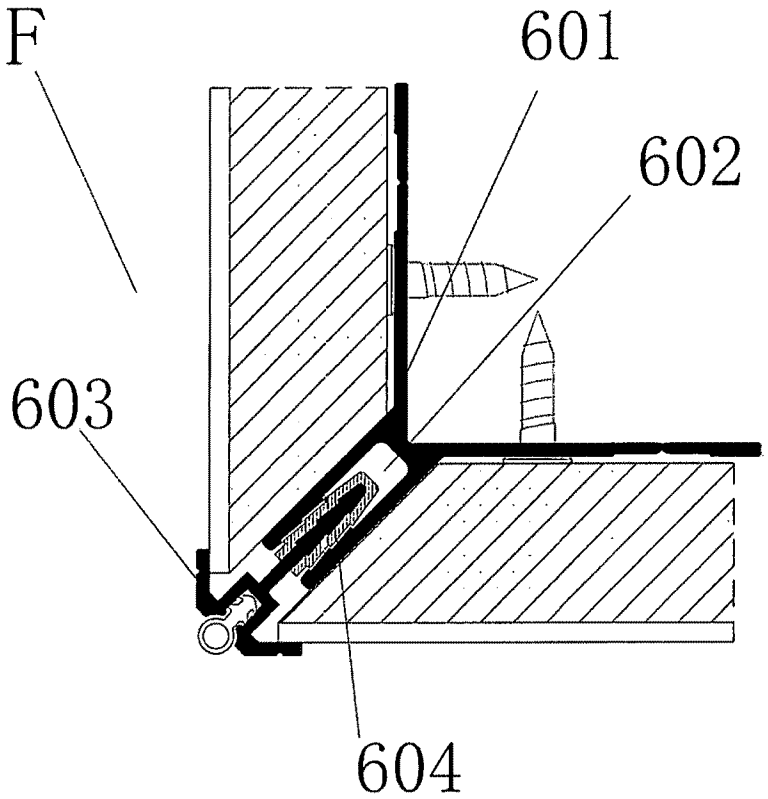
FIG. 6 is a structure diagram of a plate chamfer connecting piece according to the Invention.
Figure 7:
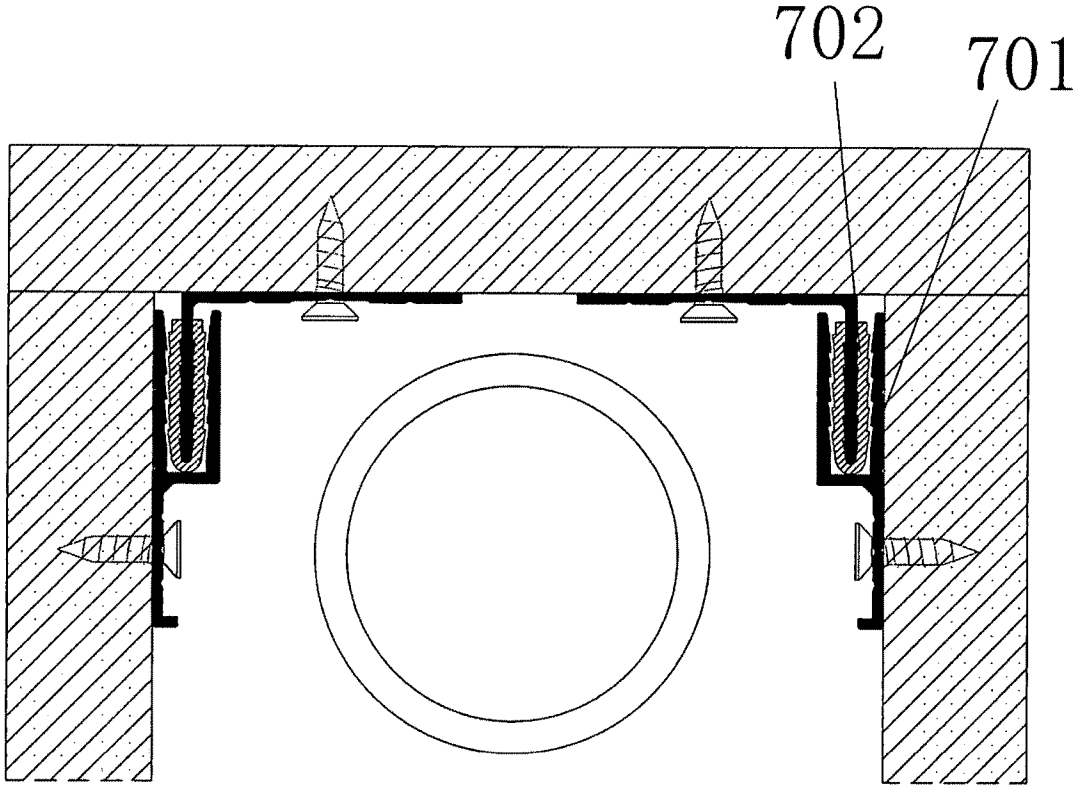
FIG. 7 is a structure diagram of a plate corner connecting piece according to the Invention.
Figure 8:
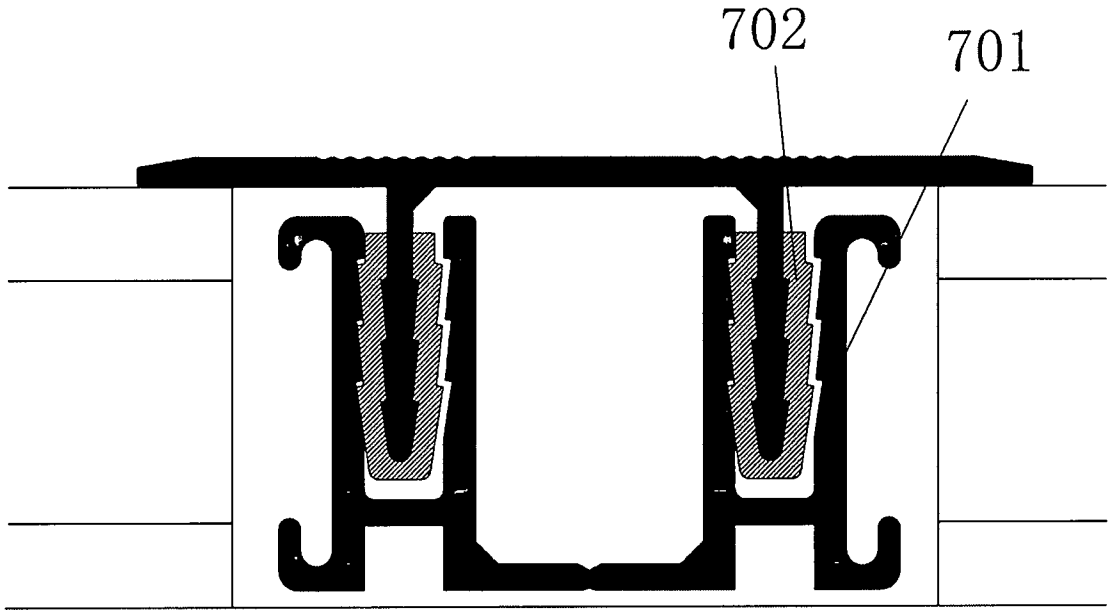
FIG. 8 is a structure diagram of a plate corner connecting piece according to the invention.
Figure 9:
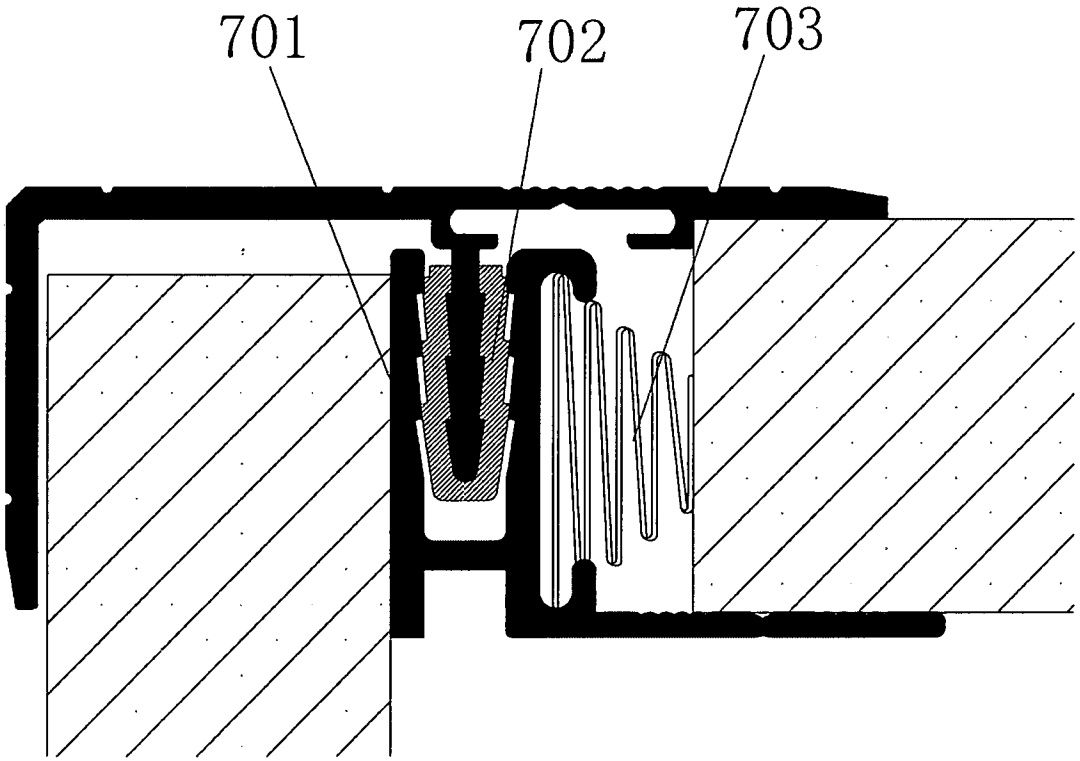
FIG. 9 is a structure diagram of a plate corner connecting piece according to the Invention.
Figure 10:
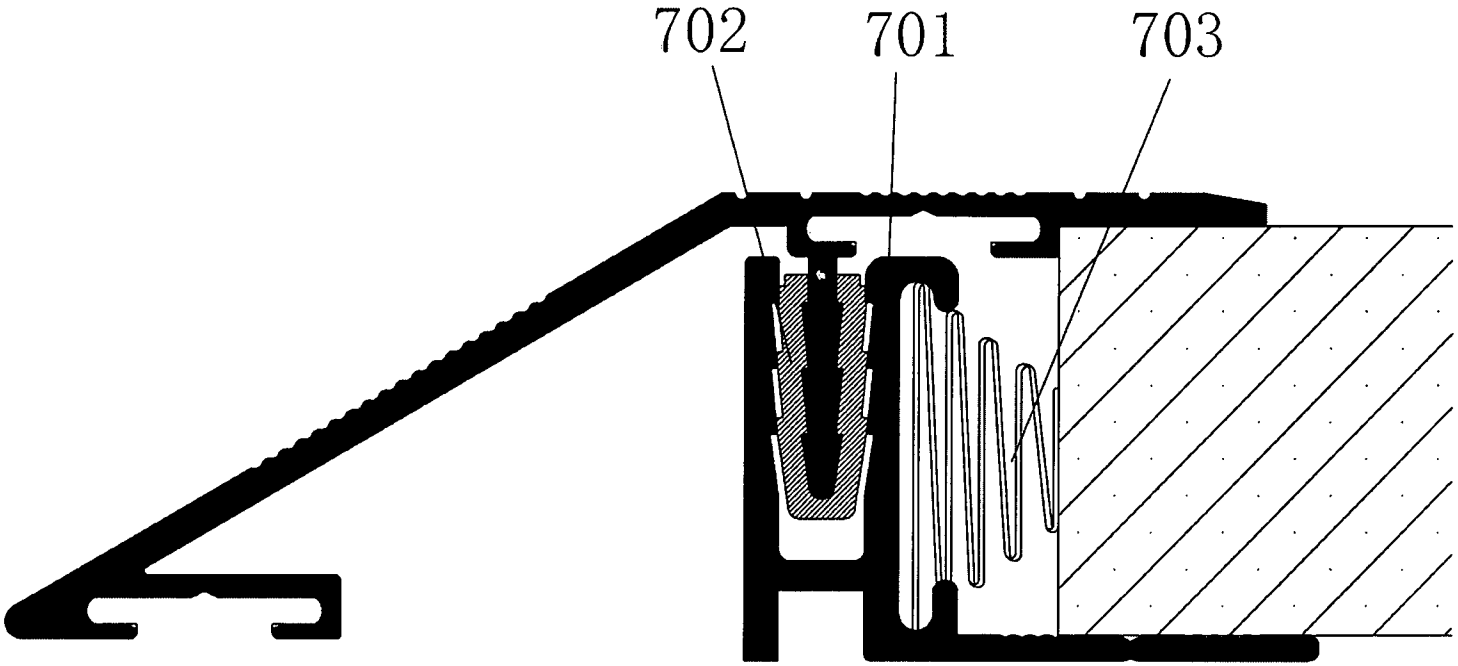
FIG. 10 is a structure diagram of a plate corner connecting piece according to the Invention.
Figure 11:
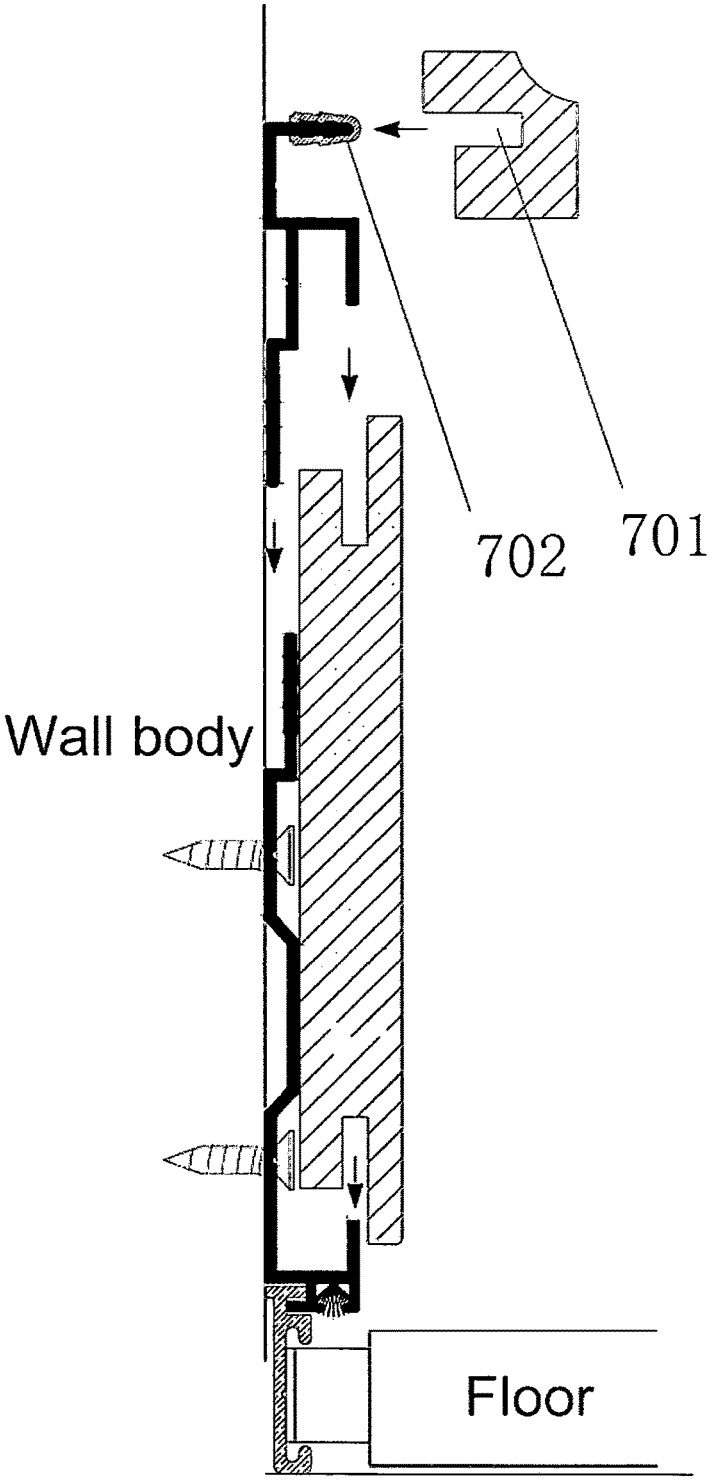
FIG. 11 is a structure diagram of a plate corner connecting piece according to the invention.
Figure 12:
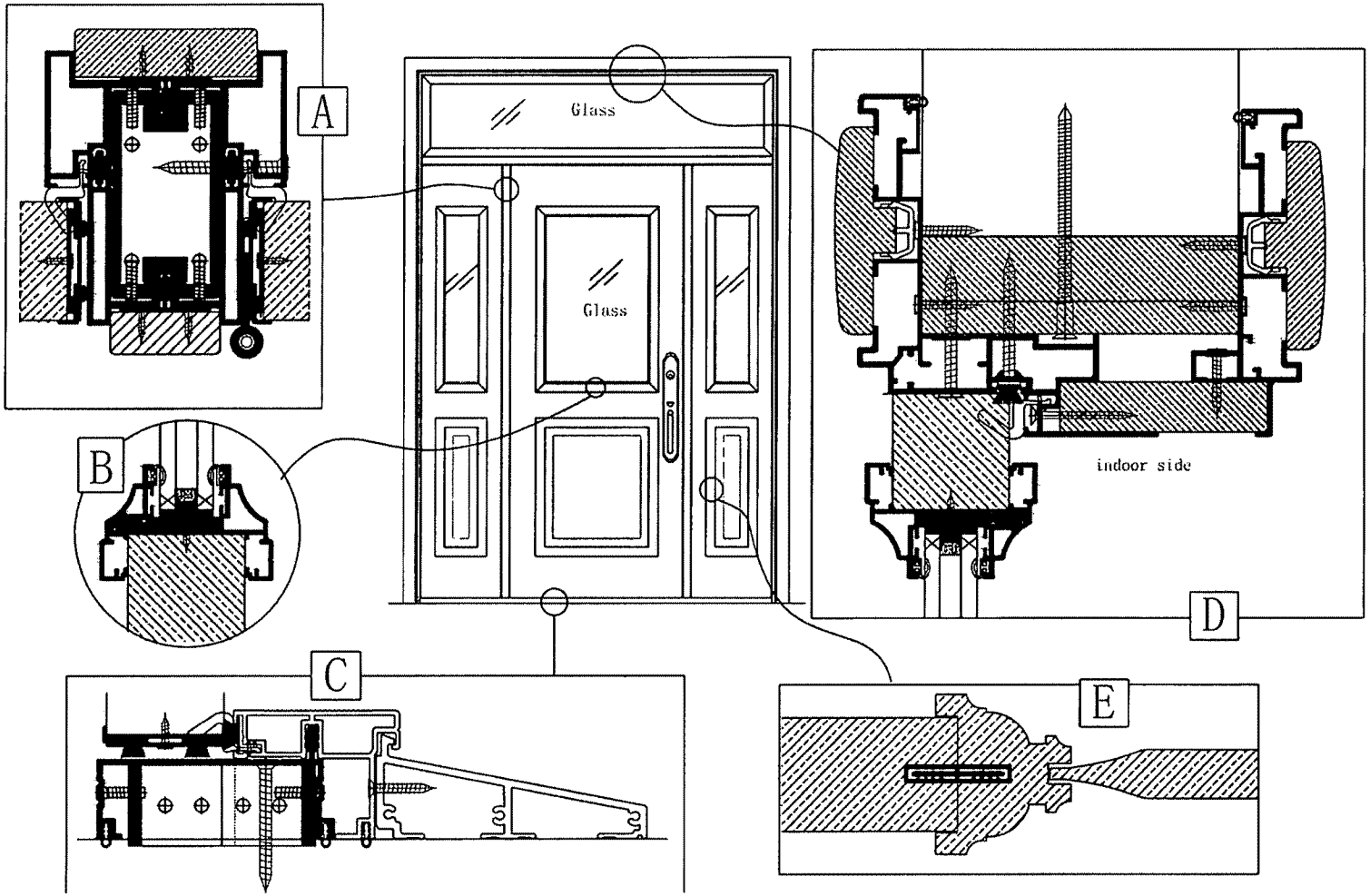
FIG. 12 is a full view of the 5 structures of the Inversion surrounding the entry door where A is a horizontal cut view from top, of the circle place in the door and doorframe. A is the FIG. 1.
Figure 13:
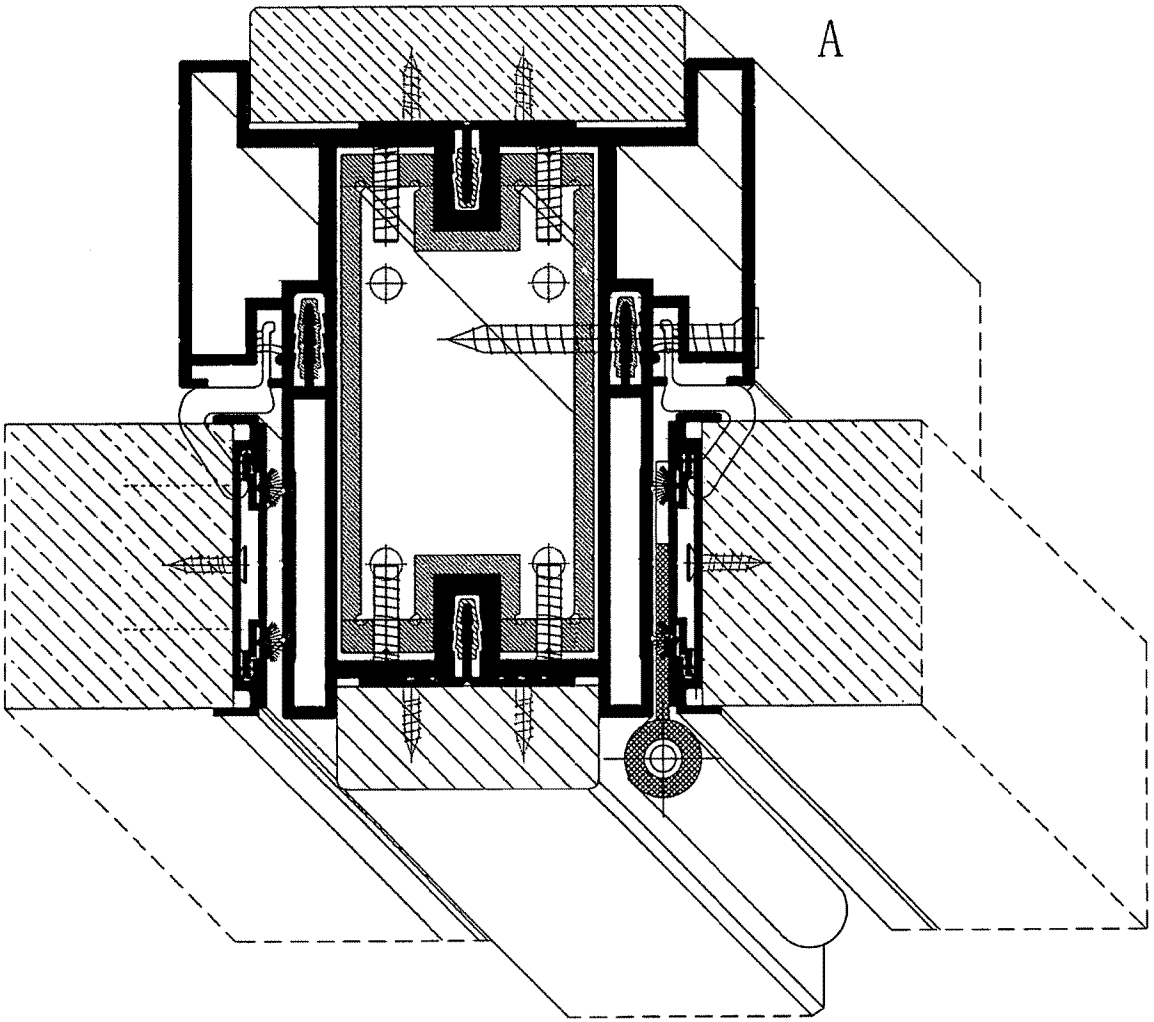
Figure 14:
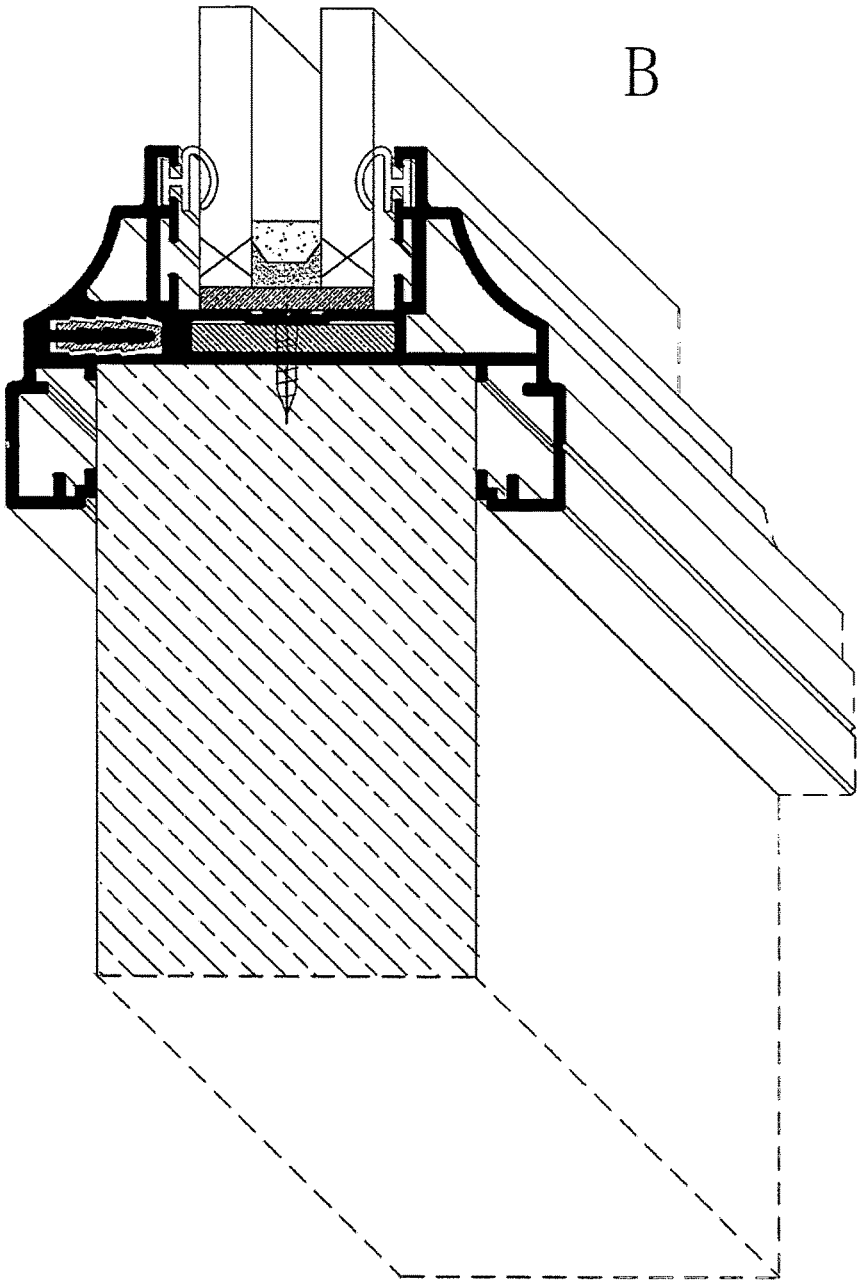
Figure 15:
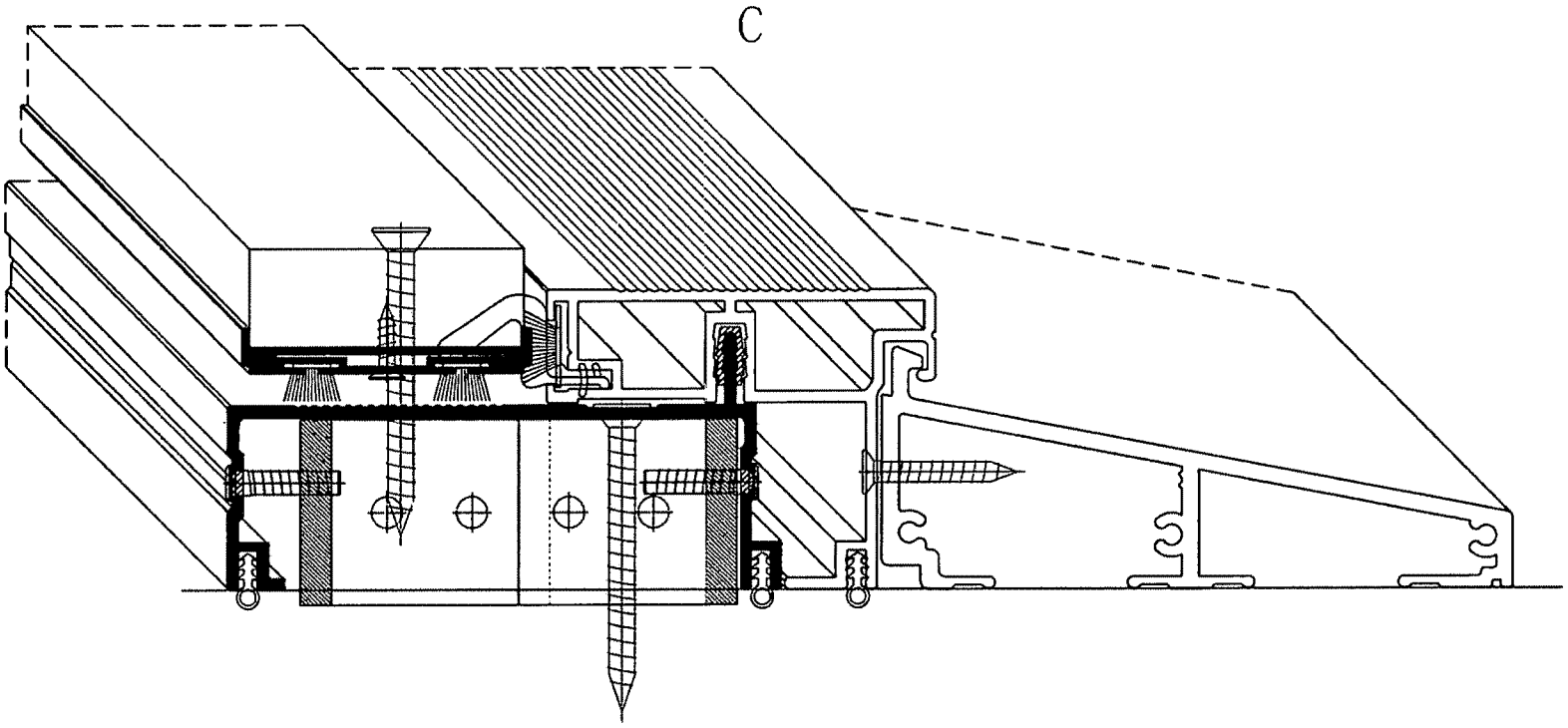
Figure 16:
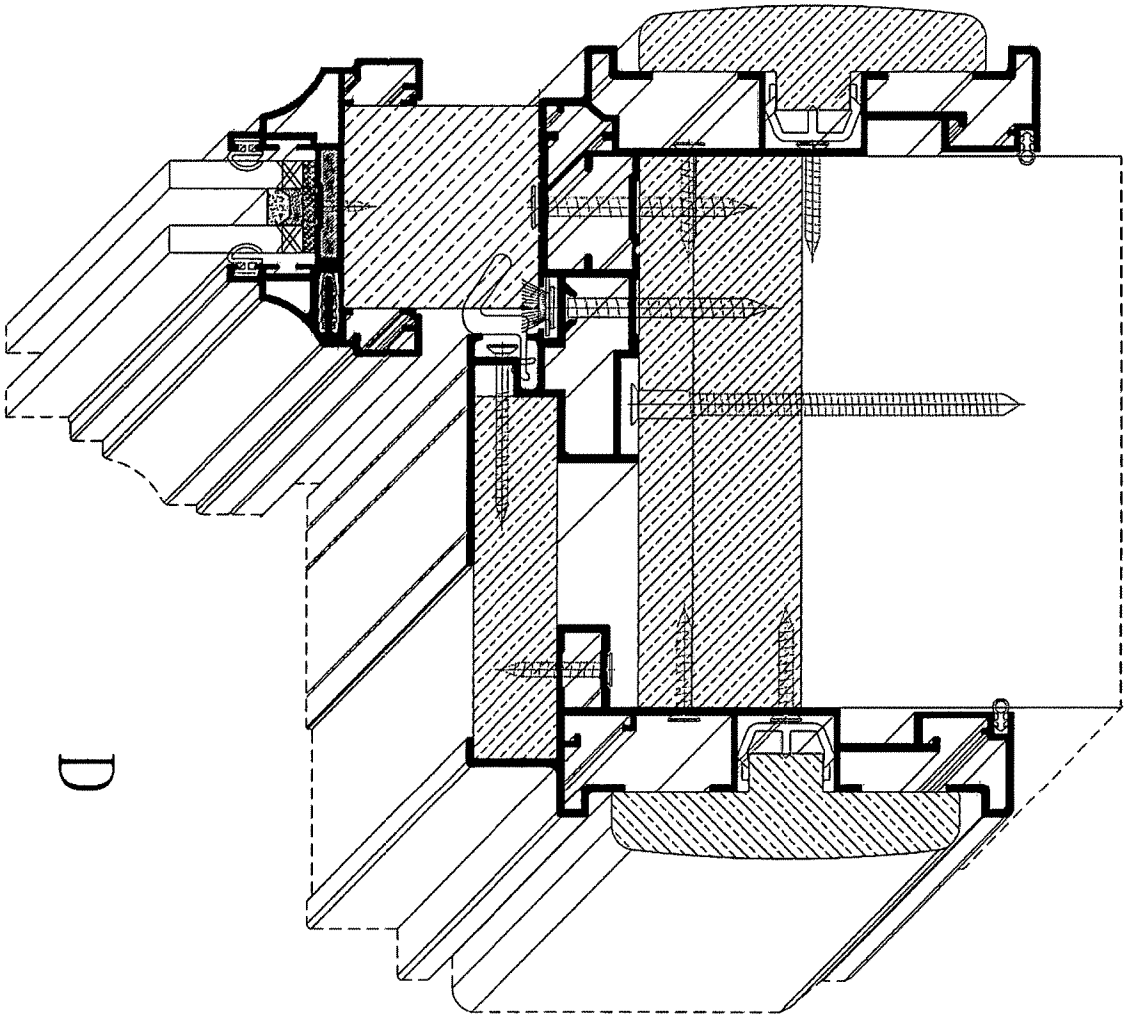
Figure 17:
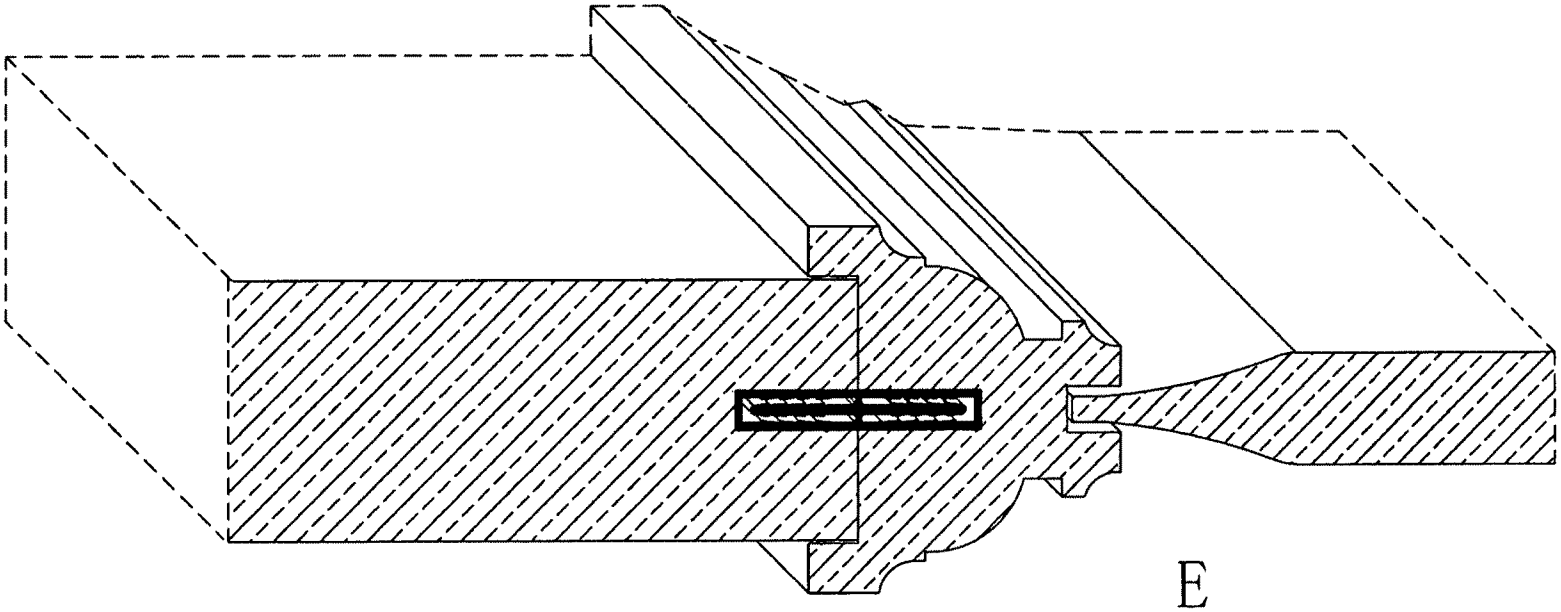
Figure 18:
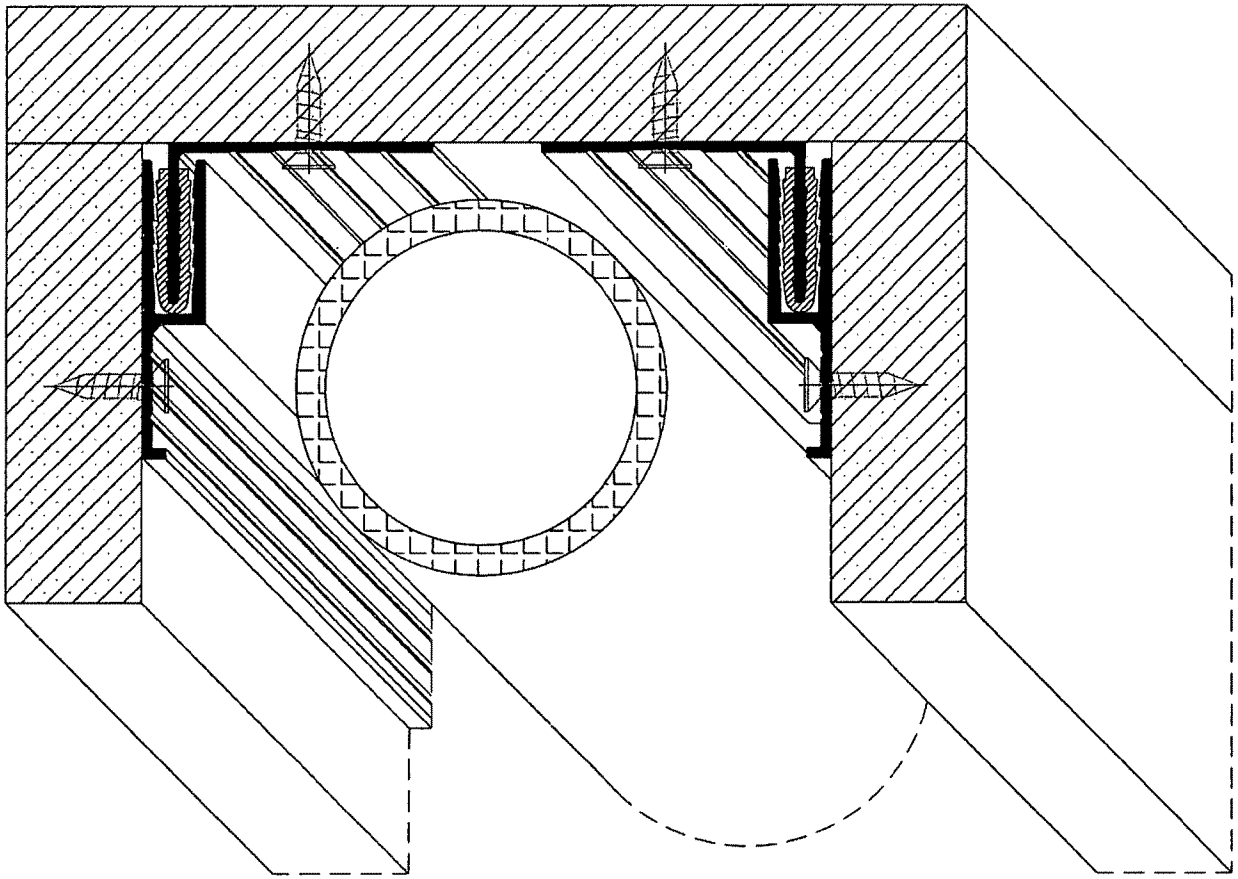
Figure 19:
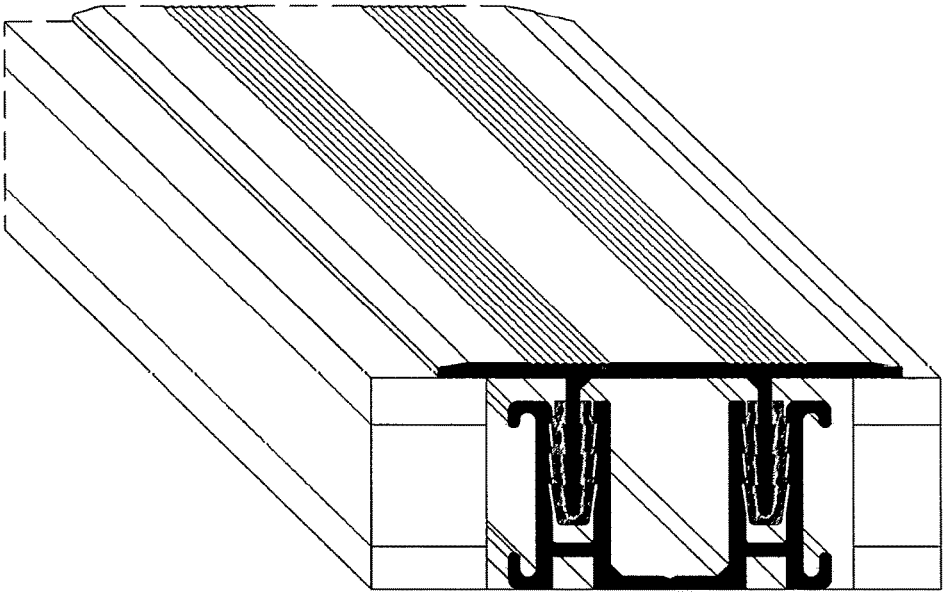
Figure 20:
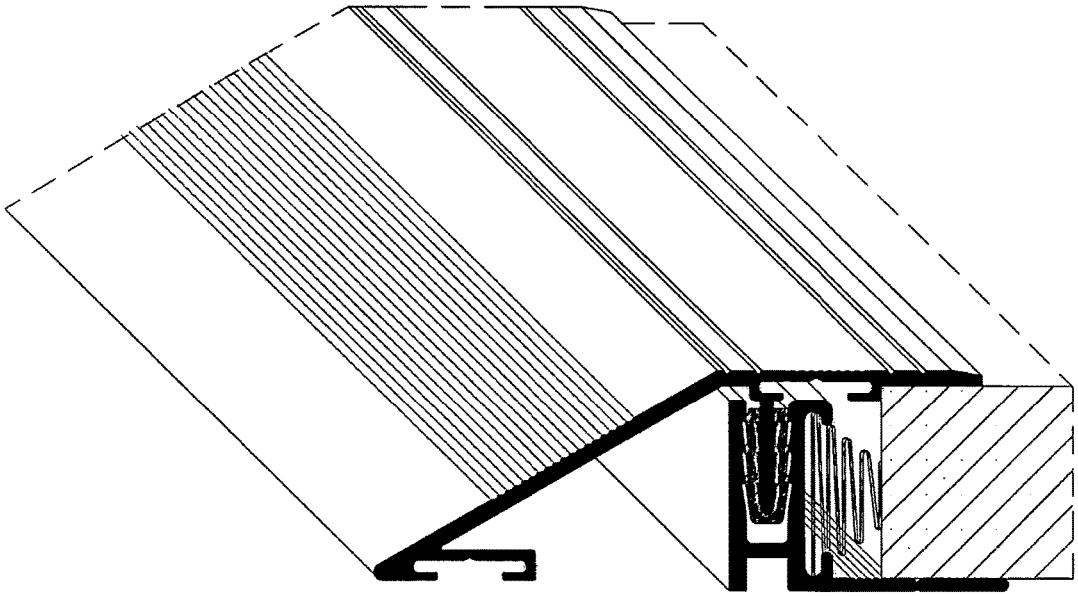
Figure 21:
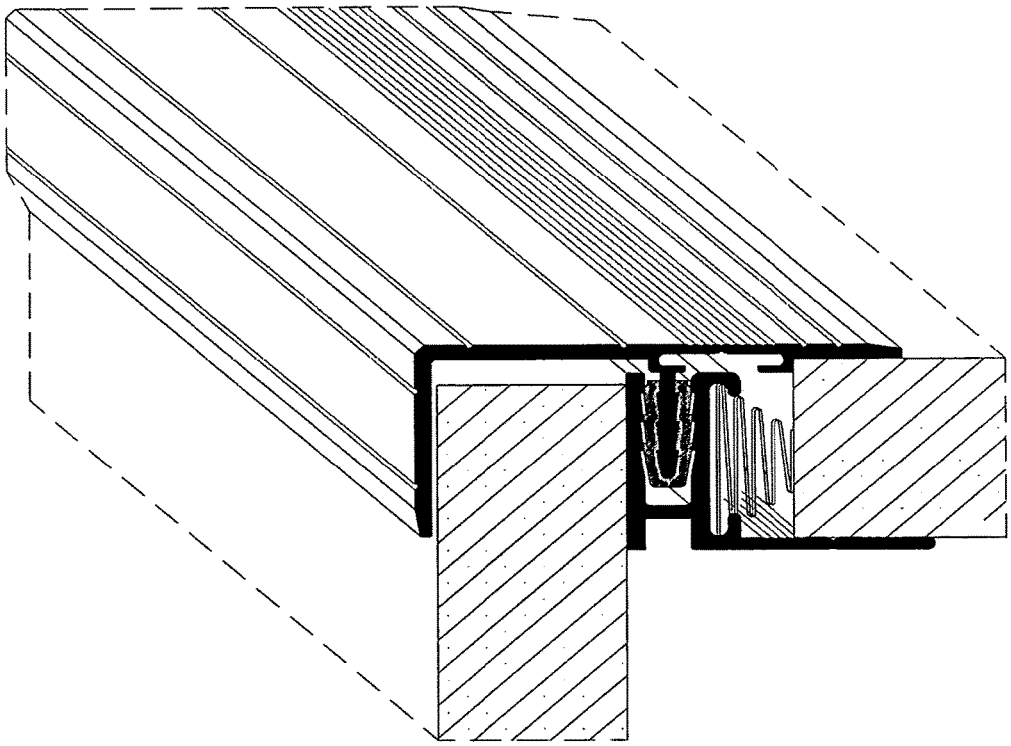
Figure 22:
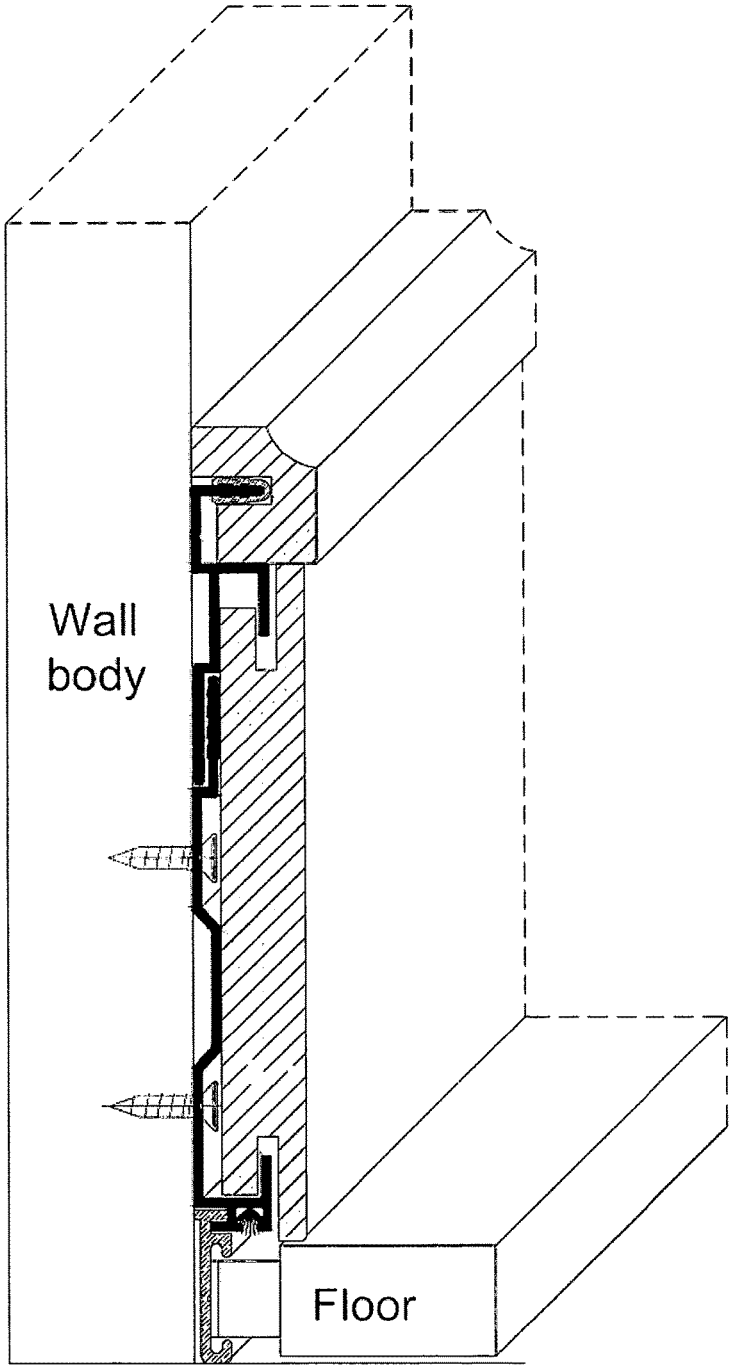
Figure 23:
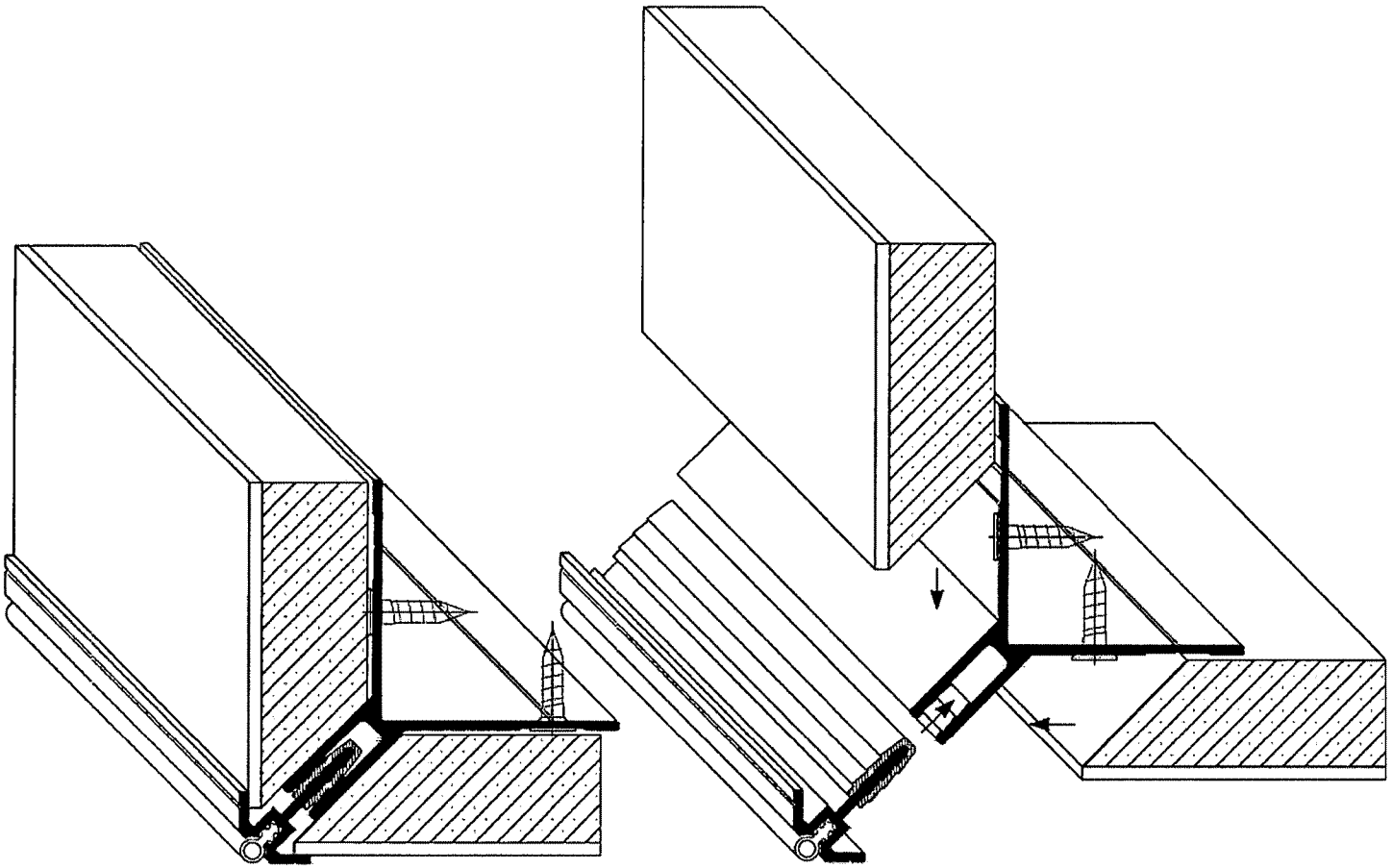
Figure 24:
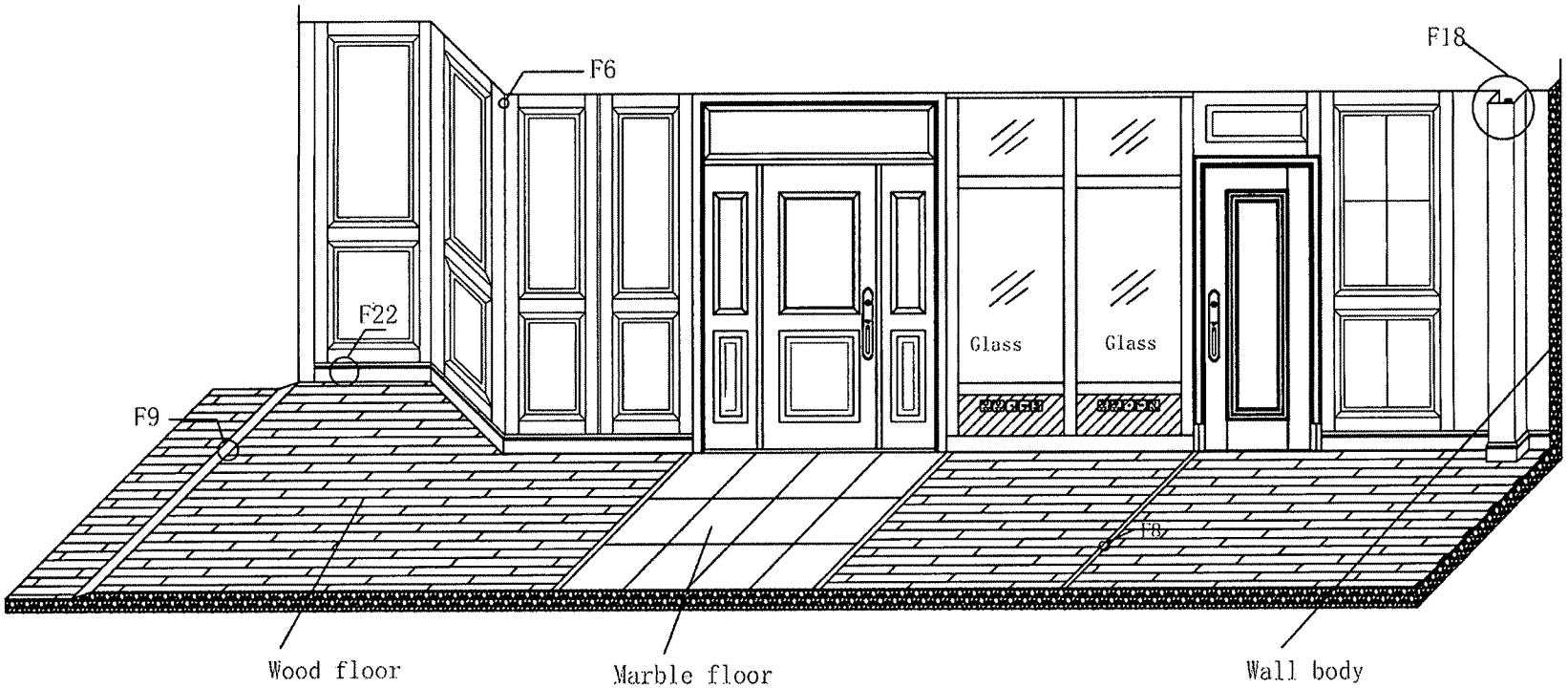

B is a vertical cut view of the circle place in the door and doorframe, B is the FIG. 2;

C is a vertical cut view of the circle place in the door and doorframe, C is the FIG. 3;

D is a vertical cut view of the circle place in the door and doorframe, D is the FIG. 4;

E is a horizontal cut view from top, of the circle place in the door and doorframe. E is the FIG. 5;

FIG. 13 is a 3-D view of the FIG. 1;

FIG. 14 is a 3-D view of the FIG. 2;

FIG. 15 is a 3-D view of the FIG. 3;

FIG. 16 is a 3-D view of the FIG. 4;

FIG. 17 is a 3-D view of the FIG. 5;

FIG. 18 is a 3-D view of the FIG. 6;

FIG. 19 is a 3-D view of the FIG. 7;

FIG. 20 is a 3-D view of the FIG. 8;

FIG. 21 is a 3-D view of the FIG. 9;

FIG. 22 is a 3-D view of the FIG. 10;

FIG. 23 is a 3-D view of the FIG. 11;

FIG. 24 is a 3-D Full View of the invention, where

F1 means the circle place horizontal cut view is show on FIG. 6,

F18 means the circle place horizontal cut view is show on FIG. 18,

F8 means the circle place vertical cut view is show on FIG. 8,

F9 means the circle place vertical I cut view is show on FIG. 9, and

F22 means the circle place vertical cut view is show on FIG. 22;

DETAILED DESCRIPTION OF THE EMBODIMENTS

Embodiment 1

A plate and plate connecting piece A includes an upright post 101, a U-shaped corner connector 102 and end connecting pieces 103, each of the two end connecting pieces is connected with a plate through screws, and is provided with two hairy fibre rods 104 which face the outer side, the two end connecting pieces are connected with the two sides of the U-shaped corner connector 102 through buckling openings, the U-shaped corner connector 102 includes a U-shaped corner connector 1021 with rubber barbed tenon structures 105 on the two sides and a U-shaped corner connector 1022 with barbed accommodation groove mortise structures 106 on the two sides, the corner connectors of the two structures are connected through the mortise and tenon structures, and the two sides are connected with a wooden decoration strip 107 through the mortise and tenon structures formed by the rubber barbed tenon structures and the barbed accommodation groove mortise structures respectively after the corner connectors are connected.

Embodiment 2

A glass (screen) and plate connecting piece f includes a (female) master glass pressure holder frame 201 and a glass pressure (males sub holder frame 202, the master glass pressure holder frame is provided with a mortise structure 203 with a batted accommodation groove, and is fixed at one end of the plate through screws, the glass pressure sub holder frame with a rubber barbed tenon structure 204 is connected with the fixed master glass pressure through the mortise and tenon structures after glass is pressed into the master glass pressure holder frame, then a section of the whole structure is trapezoidal, and elastic parts 205 capable of closely clamping the glass are arranged on the two sides of a sunken part in a part above the narrow part.

Embodiment 3

A plate bottom edge and ground connecting piece C includes a pressure frame 301, a lower door stop frame 302 and corner connector connecting piece 303, the corner connector connecting piece 303 is connected with the ground or a door casing through screw structures, the pressure frame 301 is fixed on the corner connector connecting piece 303 through screws and bolts, and the corner connector connecting piece 303 is provided with a rubber barbed tenon structure 304, and can be connected with the lower door stop frame 302 with a mortise structure 305 with a barbed accommodation groove through the mortise and tenon structures. The lower door stop frame of the plate bottom edge and ground connecting piece may be connected with a slope-shaped water retaining part 306 through screws and buckle structures, and may also be connected with other water preventing parts or water aprons.

Embodiment 4

A doorframe and wall connecting piece D includes a cushion block 401, a large door side casing 402, a small door side casing 403, E-shaped buckles 404 and wooden decoration strips 405, the cushion block 401 is connected to a wall body through screws, the large door side casing 402 is connected with the wall body and the cushion block 401 through screws, and is connected with a door casing plate through screws, the small door side casing 403 is connected with the door casing plate through buckles and screw structures, and is fixed on the inner side of the wall body through the screw structures, the large door side casing 402 and the small door casing 403 are provided with grooves into which the E-shaped buckles 404 can be embedded, and the wooden decoration strips 405 are fixed on the outer side of the large door side casing and the outer side of the small door side casing through the embedded E-shaped buckles.

Embodiment 5

A decoration plate and plate connecting piece E includes two sections of connecting rods 501 with rubber barbed tenon structures 503 and a mortise connecting piece 502 with a barbed accommodation groove 504, a contact part of each of a decoration plate 505 and the plate is provided with a mortise, and connection can be finished by arranging the mortise connecting piece with the barbed accommodation groove in the mortises of the plate and the decoration plate respectively, arranging the two ends of the connecting sections with the rubber barbed tenon structures in the mortise connecting piece with the barbed accommodation groove in the plate and the decoration plate respectively and performing pressing.

Embodiment 6

A plate chamfer connecting piece F includes a Y-shaped part 601 with a barbed accommodation groove mortise structure 602 and a T-shaped part 603 with a rubber barbed tenon structure 604, the Y-shaped part 601 is fixed on the outer side of a wall corner through screw structures, the plate is inwards pushed along the two side edges of the Y-shaped part 601, the rubber barbed tenon structure 604 of the T-shaped part 603 is pressed into the mortise structure 602 of the T-shaped part, and a T-shaped guard plate is attached to the outer side of the plate on the two sides of the Y-shaped part for fixation.

Embodiment 7

A plate corner connecting piece includes a part 701 with a barbed accommodation groove mortise structure and a part 702 with a rubber barbed tenon structure, and a spring part 703 may be additionally arranged under the condition that the parts are required to be pressed.

The embodiments only describe the technical concept and characteristics of the invention, aim to enable those skilled in the art to understand the contents of the invention and implement the invention on such a basis, and are not intended to limit the scope of protection of the invention. Any equivalent variation and modification made according to the essence of the contents of the invention shall fall within the scope of protection of the invention.

The invention claimed is:

1. A home plate connecting device, comprises a plural of plates and plate connecting pieces, a plural of glass screens and plate connecting pieces, a plural of plate bottom edge and ground connecting pieces, a plural of decorative plates and plate connecting pieces, a plural of doorframe and wall connecting pieces, a plural of plate chamfer connecting pieces, a plural of plate corner connecting pieces, wherein the plate and plate connecting piece comprises an upright post, a male U-shaped corner connector, a female U-shaped corner connector, and 2 (two) end-connecting pieces wherein, each of the end connecting pieces is connected with a plate through screws, and is provided with two hairy fibre rods which face the outer-side of the male U-shaped corner connector; the two end connecting pieces are connected with the two outer-sides of the male U-shaped corner connector through buckling openings, the male U-shaped corner connector comprises a U-shaped corner connector with rubber barbed tenon structures on the two side-arms of U-shape, and barbed accommodation groove mortise structures on the bottom outer-side of U-shape; and the female U-shaped corner connector with barbed accommodation groove mortise structures on the two side-arms and the bottom outer-side of U-shape; the male U-shaped corner connector's two side-arm tenon structures plug into female U-shaped corner connector's two arm mortise structures to connect together; and each of the bottom of the both U-shaped corner connectors is assembled with a wooden decoration strip through the rubber barbed tenon structure piece which is screwed onto the wooden decoration strip, corresponding to the barbed accommodation groove mortise structure in the bottom outside of U-shaped corner connectors respectively after the male and female U-shaped corner connectors are connected together;

the glass screen and plate connecting piece comprise a female glass screen pressure holder frame and a male glass screen pressure holder frame, the female glass screen pressure holder frame has a mortise structure with a barbed accommodation groove, and is fixed at one end of the plate through screws, the male glass screen pressure holder frame has a rubber barbed tenon structure which is able to tightly plug into the mortise structure of the female glass screen pressure holder frame after glass screen is pressed into right position of the female glass screen pressure holder frame; After them tightly connected together, the section of the whole structure's perpendicular cut view looks like is trapezoidal. Elastic parts which are capable to tightly-clamping the glass screen are arranged on the two sides of a sunken part of holding arm in both male and female glass screen holder frames;

the plate bottom edge and ground connecting piece comprises a pressure trim a lower door stop frame and a corner connector connecting piece, the corner connector connecting piece is connected to the ground or a door casing through screws, the pressure trim is fixed on the corner connector connecting piece through screws and bolts, and the corner connector connecting piece is provided with a rubber barbed tenon structure, and can be connected to the lower door stop frame with a mortise structure with a barbed accommodation groove through the mortise and tenon structures;

the doorframe and wall connecting piece comprises a cushion block, an outdoor-side door side casing frame, an indoor-side door side casing frame wherein outdoor-side door side casing frame is wider than indoor-side door side casing frame, a plural of E-shaped buckles and a plural of wooden decoration strips. The cushion block is connected to wall body through screws, the outdoor-side door side casing frame is connected with the wall body and the cushion block through screws, and is connected with a door side casing plate through buckles; the indoor-side door side casing frame is connected with the cushion block through screws, and is connected with the door side casing plate through buckles; the outdoor-side door side casing frame and the indoor-side door side casing frame are provided with grooves into which the E-shaped buckles can be embedded, and the wooden decoration strips are fixed onto the outer side of the door side casing frames through the embedded E-shaped buckles;

the decoration plate and plate connecting piece comprise connecting rods, wherein the rod with both ends having rubber barbed tenon structures; a mortise connecting piece with a barbed accommodation groove; a contact part of decoration plates with corresponding mortises. The assembling can be finished by arranging the mortise connecting piece with the barbed accommodation groove in the mortises of the plate and the decoration plate respectively, inserting each end of the connecting rods into corresponding rubber barbed tenon structures in the mortise connecting piece with the barbed accommodation groove in the plate and in the decoration plate respectively and performing pressing, the assembling in done;

the plate chamfer connecting piece comprises a Y-shaped part with a barbed accommodation groove mortise structure and a T-shaped part with a rubber barbed tenon structure, the Y-shaped part is fixed on the outer side of a wall corner through screw structures, the plate is inwards pushed along the two side edges of the Y-shaped part, the rubber barbed tenon structure of the T-shaped part is pressed into the mortise structure of the T-shaped part, and a T-shaped guard plate is attached to the outer side of the plate on the two sides of the Y-shaped part for fixation; and the plate corner connecting piece comprises a parts with a barbed accommodation groove mortise structure, a parts with a rubber barbed tenon structure, and a spring parts, that may be additionally arranged under the condition that the parts is required to be pressed.

2. The home plate connecting device according to claim 1, wherein the lower door stop frame of the plate bottom edge and ground connecting piece may be connected with a slope-shaped water preventing part through screws and buckle structures.

3. The home plate connecting device according to claim 1, wherein rubber anti-collision parts are arranged on parts, contacting with a wall surface, of the outdoor-side and indoor-side door side casing frames of the doorframe and wall connecting piece.

4. The home plate connecting device according to claim 1, wherein each connecting piece may be made from aluminium, plastic steel or wood.

* * * * *